US007423612B2

(12) United States Patent
Choi

(10) Patent No.: US 7,423,612 B2
(45) Date of Patent: Sep. 9, 2008

(54) METHODS FOR RESETTING AND DRIVING PLASMA DISPLAY PANELS IN WHICH ADDRESS ELECTRODE LINES ARE ELECTRICALLY FLOATED

(75) Inventor: Hak-ki Choi, Cheonan-si (KR)

(73) Assignee: Samsung SDI Co., Ltd., Suwon (KR)

( * ) Notice: Subject to any disclaimer, the term of this patent is extended or adjusted under 35 U.S.C. 154(b) by 675 days.

(21) Appl. No.: 10/888,891

(22) Filed: Jul. 12, 2004

(65) Prior Publication Data

US 2005/0007313 A1 Jan. 13, 2005

(30) Foreign Application Priority Data

Jul. 12, 2003 (KR) ..... 10-2003-0047534

(51) Int. Cl.
*G09G 3/28* (2006.01)

(52) U.S. Cl. ..... 345/60; 315/169.4

(58) Field of Classification Search ..... 345/60–72, 345/690–693; 315/169.1, 169.4
See application file for complete search history.

(56) References Cited

U.S. PATENT DOCUMENTS 5,745,086 A * 4/1998 Weber ..... 345/63
5,844,373 A * 12/1998 Yao et al. ..... 315/205
6,528,952 B2 * 3/2003 Kato et al. ..... 315/169.4

FOREIGN PATENT DOCUMENTS

JP 11338417 A * 12/1999
JP 2002-258795 9/2002

* cited by examiner

*Primary Examiner*—Alexander Eisen
*Assistant Examiner*—Kenneth B Lee, Jr.
(74) *Attorney, Agent, or Firm*—H.C. Park & Associates, PLC

(57) ABSTRACT

A method of resetting a plasma display panel includes a wall charge accumulation operation and a wall charge distribution operation. In the wall charge accumulation operation, the voltage applied to second display electrode lines is gradually increased to reach a first voltage. In the wall charge distribution operation, while the voltage applied to the first display electrode lines is maintained at a second voltage lower than the first voltage, the voltage applied to the second display electrode lines is gradually decreased to reach a third voltage lower than the second voltage and address electrode lines are electrically floated.

15 Claims, 7 Drawing Sheets

METHODS FOR RESETTING AND DRIVING PLASMA DISPLAY PANELS IN WHICH ADDRESS ELECTRODE LINES ARE ELECTRICALLY FLOATED

CROSS-REFERENCE TO RELATED APPLICATIONS

This application claims the priority of Korean Patent Application No. 2003-47534, filed on Jul. 12, 2003, in the Korean Intellectual Property Office, the disclosure of which is incorporated herein in its entirety by reference.

BACKGROUND OF THE INVENTION

1. Field of the Invention

The present invention relates to a method of resetting a plasma display panel and a method for driving a plasma display panel using the resetting method.

2. Description of the Related Art

One typical type of plasma display panel is configured to have a three-electrode surface discharge structure. Front and rear substrates, usually glass substrates, are provided. A is number of address (A) electrodes are formed in parallel on one of the two substrates, and parallel scan (Y) and sustain (X) electrodes are formed in a direction perpendicular to that of the address electrodes on another substrate. Partition walls are formed, for example, on the substrate with the address electrodes, to divide the panel into a number of individual discharge cells. Phosphors are provided between the partition walls. The space between the two substrates is filled with a plasma-generating gas, discharges between the electrodes generate plasma, the phosphors are excited by the ultraviolet radiation of the plasma, and the discharge cell is thus caused to illuminate.

Plasma panels such as those described above are driven so that particular discharge cells are illuminated in order to display an image. Most driving methods employ, sequentially, a resetting operation, an addressing operation, and a display-sustain operation in each unit sub-field. The resetting operation is performed to uniformly distribute electric charges in all display cells. The addressing operation is performed to create a desired wall voltage in selected cells to display an image. The display-sustain operation is performed to apply a predetermined alternating current voltage to all the X and Y electrode-line pairs so that display-sustain discharge is caused in selected display cells with desired wall voltages that were applied in the addressing operation.

The resetting operation includes steps. The first step of the resetting operation involves removing wall charges generated by previous display-sustain operations by applying certain voltages between the A, X, and Y electrodes. Once wall charges generated by previous display-sustain operations are removed, voltages are applied to distribute wall charges on the various electrodes so as to facilitate future addressing and display-sustain operations. Specifically, in the last portion of the resetting operation, the A electrode lines are typically held at a ground voltage, the X electrode lines are held at an elevated voltage, and the Y electrode lines are ramped from a high voltage to a low voltage. This causes a weak discharge between the X and Y electrodes in each discharge cell, and negative charges move toward the X electrodes. Therefore, the wall electric potential of the X electrodes becomes lower than that of the A electrodes and higher than that of the Y electrodes. This reduces the voltage required for discharge between Y electrode lines and address electrode lines in the following addressing operation.

Because the A electrodes are held at a ground voltage during the final step of the resetting operation, discharge occurs for both the X and Y electrode lines. However, discharge for both the X and Y electrode lines is typically unnecessary. The unnecessary discharge may degrade the contrast performance of the plasma display device. Additionally, because of the unnecessary discharge, wall charges with positive polarities that are present around the address electrode lines disappear. Therefore, the voltage between the address electrode lines and the Y electrode lines, which is created by the wall charges, is relatively low. Consequently, the addressing voltage required for discharge between the Y electrode lines and the address electrode lines selected in the addressing time is relatively high.

SUMMARY OF THE INVENTION

One aspect of the invention relates to a method of resetting a plasma display panel having a three-electrode discharge cell configuration. The method comprises gradually increasing a voltage applied to second display electrode lines to reach a first voltage. The method also comprises gradually decreasing a voltage applied to the second display electrode lines to reach a third voltage lower than a second voltage, and electrically floating address electrode lines while maintaining a voltage applied to first display electrode lines at a second voltage lower than the first voltage.

Another aspect of the invention relates to a method for driving a plasma display panel having a three-electrode surface discharge cell configuration. The method comprises dividing a unit frame into a plurality of sub-fields for time-division gradation display and performing resetting, addressing, and display sustain in the plurality of sub-fields. The resetting comprises several tasks. Specifically, the resetting comprises gradually increasing a voltage applied to second display electrode lines to reach a first voltage. The resetting also comprises gradually decreasing a voltage applied to the second display electrode lines to reach a third voltage lower than a second voltage, and electrically floating address electrode lines while maintaining a voltage applied to first display electrode lines at a second voltage lower than the first voltage.

Yet another aspect of the invention relates to a method of driving a plasma display panel having a three-electrode discharge cell configuration. The method comprises, during a resetting operation on one or more of the discharge cells, electrically floating an address electrode.

BRIEF DESCRIPTION OF THE DRAWINGS

The present invention will be described with reference to the attached drawings, in which.

DETAILED DESCRIPTION OF THE INVENTION

Figure 1:
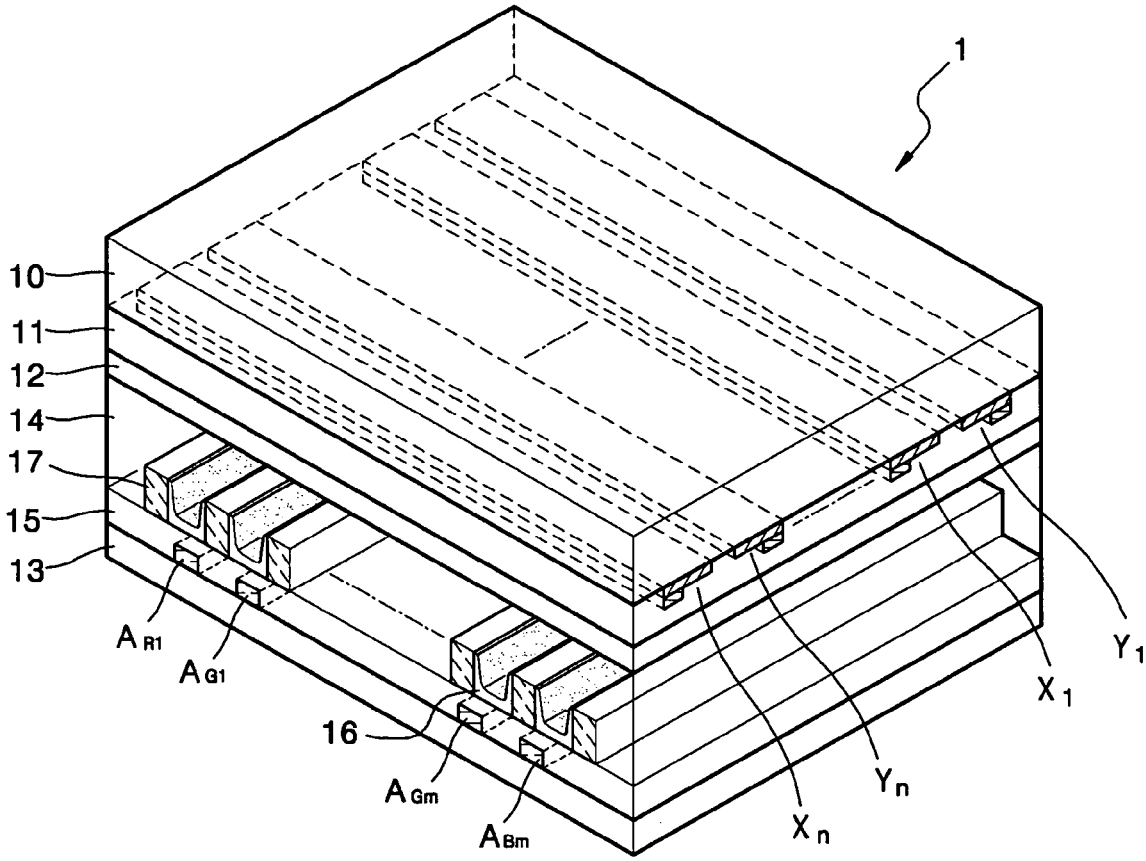
FIG. 1 is a perspective view illustrating the structure of a plasma display panel with a three-electrode surface discharge structure that may be used with methods according to embodiments of the present invention.
Figure 2:
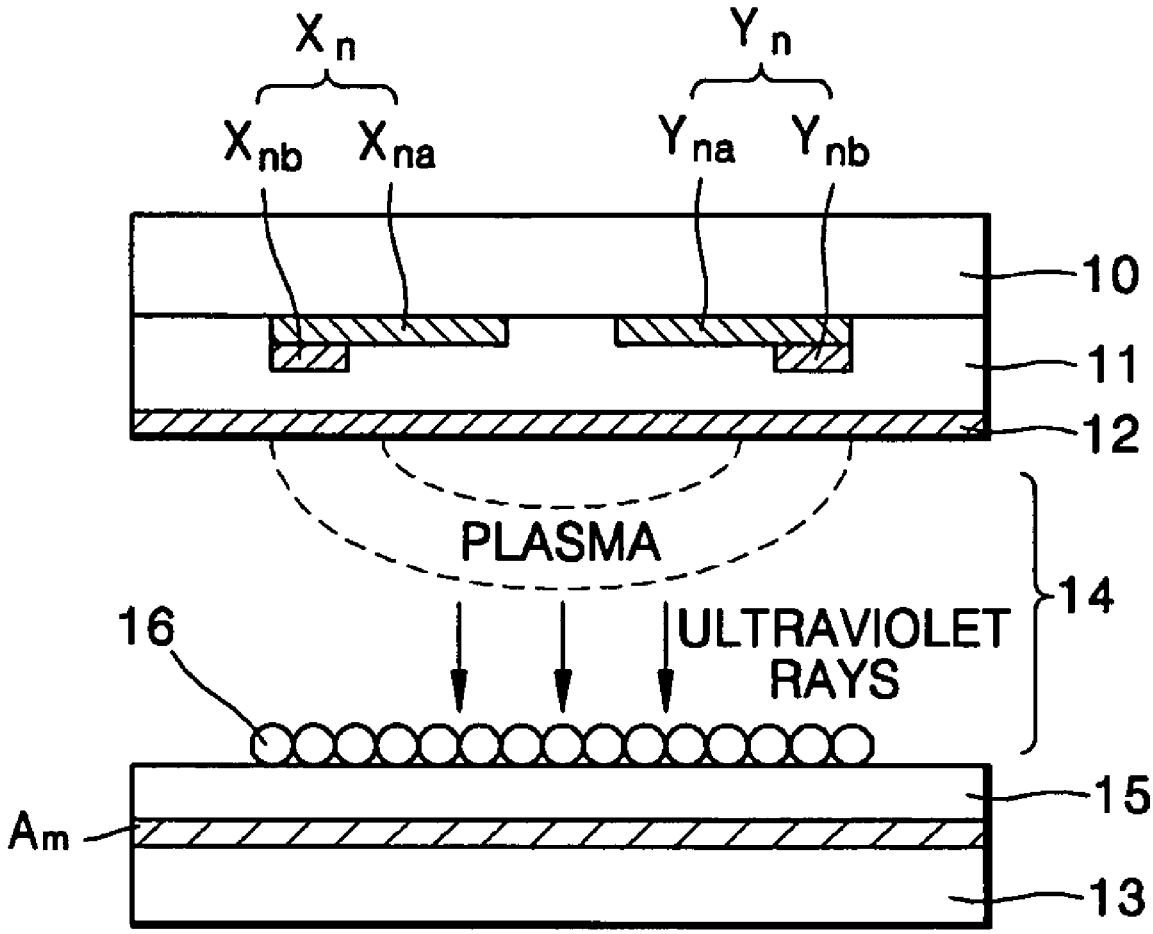
FIG. 2 is a schematic cross-sectional view illustrating an exemplary discharge cell in the plasma display panel of FIG. 1.

FIG. 1 is a perspective view illustrating the structure of a plasma display panel with a conventional three-electrode surface discharge structure. FIG. 2 is a schematic cross-sectional view of one discharge or display cell in the plasma display panel of FIG. 1. As shown in FIGS. 1 and 2, address electrode lines $A_{R1}, \ldots, A_{Bm}$, dielectric layers 11 and 15, Y-electrode lines $Y_1, \ldots, Y_n$, X-electrode lines $X_1, \ldots, X_n$, phosphors 16, partition walls 17, and a MgO layer 12 as a protection layer are provided between front and rear glass substrates 10 and 13 of a surface discharge type plasma display panel 1.

The address electrode lines $A_{R1}, \ldots, A_{Bm}$ are formed in a predetermined pattern on an upper surface of the rear glass substrate 13. The lower dielectric layer 15 is formed to cover the address electrode lines $A_{R1}, \ldots, A_{Bm}$. The partition walls 17 are formed so as to be parallel to the address electrode lines $A_{R1}, \ldots, A_{Bm}$ on the upper surface of the lower dielectric layer 15. The partition walls 17 partition discharge areas of display cells and prevent cross-talk between the display cells. The phosphors 16 are formed between respective partition walls 17.

The X-electrode lines $X_1, \ldots, X_n$ and Y-electrode lines $Y_1, \ldots, Y_n$ are formed in a predetermined pattern on the lower surface of the front glass substrate 10 in a manner such that the X-electrode lines $X_1, \ldots, X_n$ and Y-electrode lines $Y_1, \ldots, Y_n$ intersect with the address electrode lines $A_{R1}, \ldots, A_{Bm}$. Each intersection forms a corresponding display cell. Each of the X-electrode lines $X_1, \ldots, X_n$ and each of the Y-electrode lines $Y_1, \ldots, Y_n$ are formed by coupling transparent electrode lines ($X_{na}$ and $Y_{na}$, shown in FIG. 2) comprised of a transparent conductive material such as ITO (Indium Tin Oxide) with metal electrode lines ($X_{nb}$ and $Y_{nb}$, shown in FIG. 2) that enhance conductivity. The upper dielectric layer 11 is formed to cover the X-electrode lines $X_1, \ldots, X_n$ and Y electrode lines $Y_1, \ldots, Y_n$. A protection layer 12 that protects the plasma display panel 1 from damage due to strong electric fields, for example, a MgO layer, is formed on the lower surface of the front electronic layer 11. A discharge space 14 is filled with plasma-forming gas and is sealed.

Figure 3:
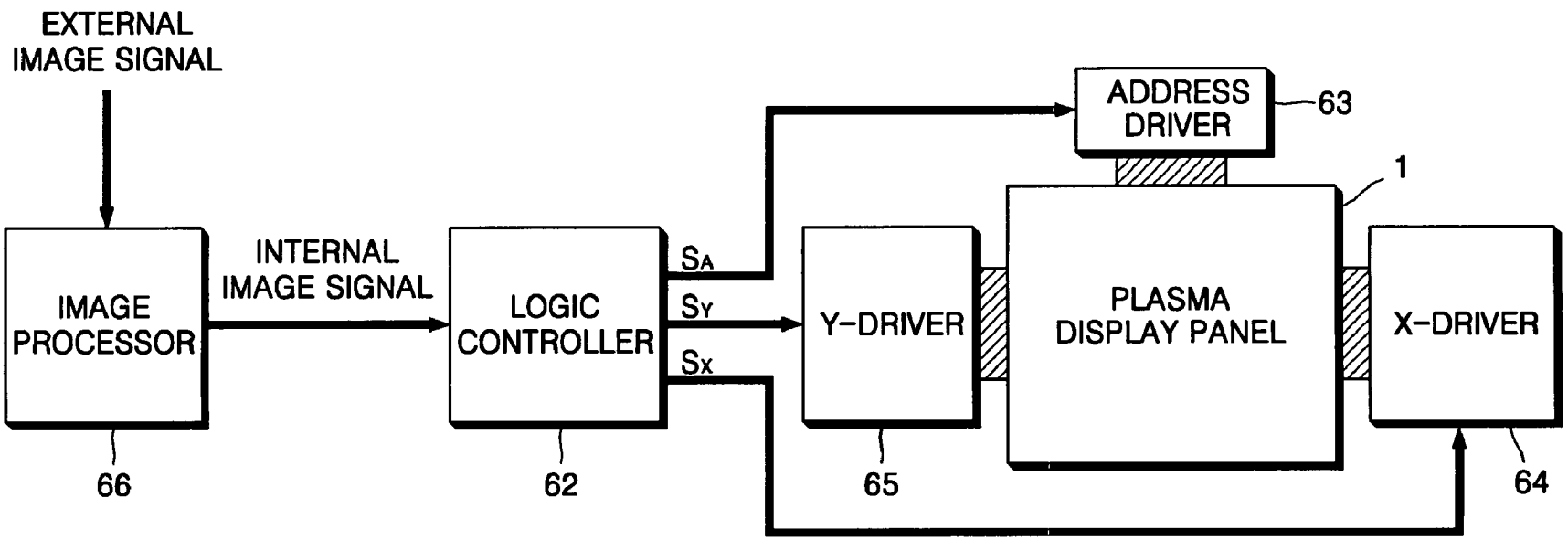
FIG. 3 is a schematic diagram of a driving apparatus for driving the plasma display panel of FIG. 1.

FIG. 3 is a schematic diagram of a driving apparatus used in the plasma display panel 1 of FIG.1 in methods according to embodiments of the invention. As shown in FIG. 3, the driving apparatus for driving the plasma display panel 1 includes an image processor 66, a logic controller 62, an address driver 63, an X driver 64, and a Y driver 65. The image processor 66 converts external analog image signals into digital signals to generate internal image signals, for example, red (R), green (G), and blue (B) image data, each digital signal having 8 bits, clock signals, and vertical and horizontal synchronization signals. The logic controller 62 generates driving control signals $S_A$, $S_Y$, and $S_X$ according to the internal image signals output from the image processor 66. The address driver 63 processes the address signal $S_A$ output from the logic controller 62, generates a display data signal, and applies the display data signal to the address electrode lines. The X driver 64 processes the X driving control signal $S_X$ output from the controller 62 and applies the X driving control signal $S_X$ to the X electrode lines. The Y driver 65 processes the Y driving control signal $S_Y$ output from the logic controller 62 and applies the Y driving control signal $S_Y$ to the Y electrode lines.

Figure 4:
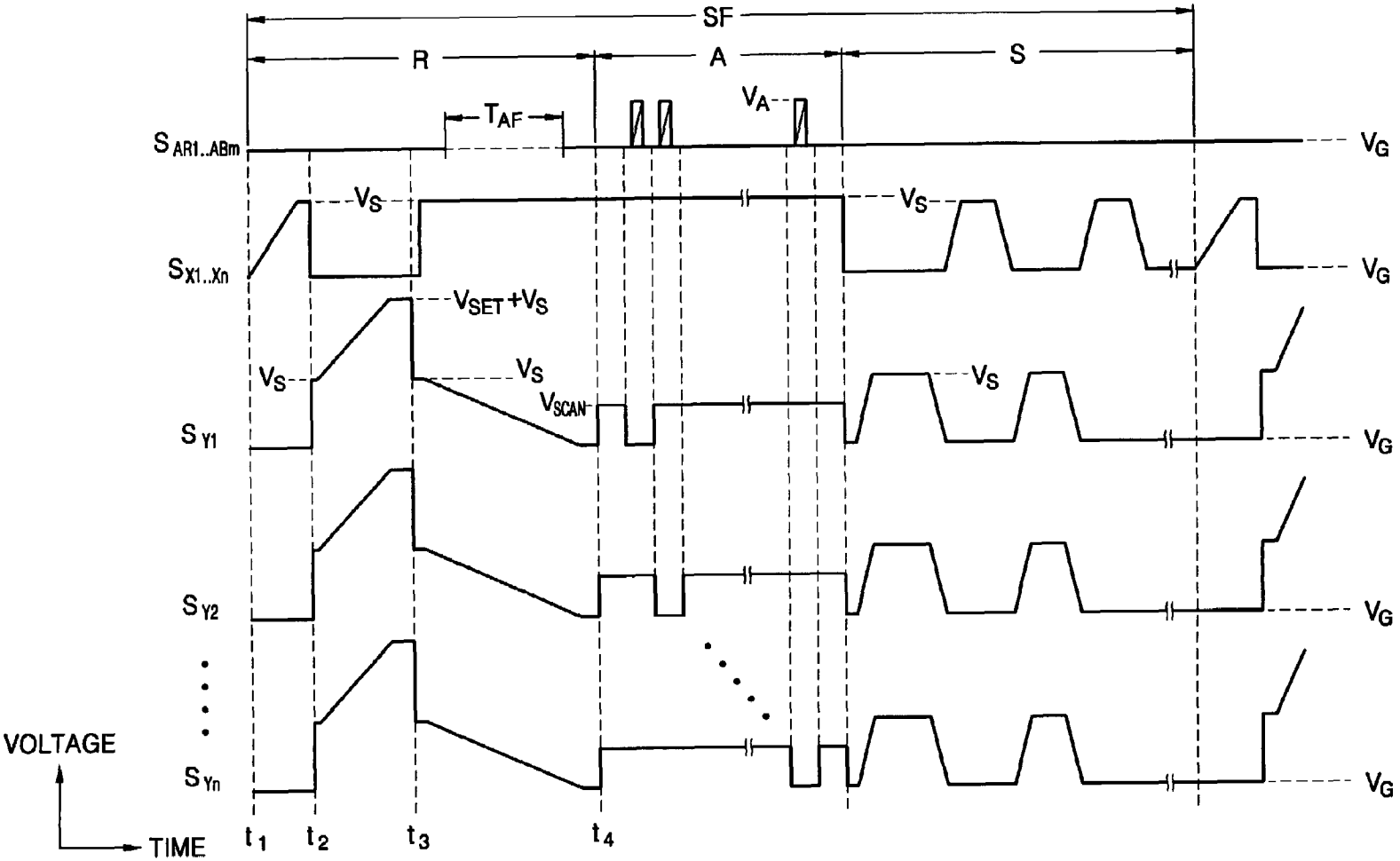
FIG. 4 is a waveform diagram illustrating driving signals applied to electrode lines of a plasma display panel, in a resetting method according to an embodiment of the present invention.
Figure 5:
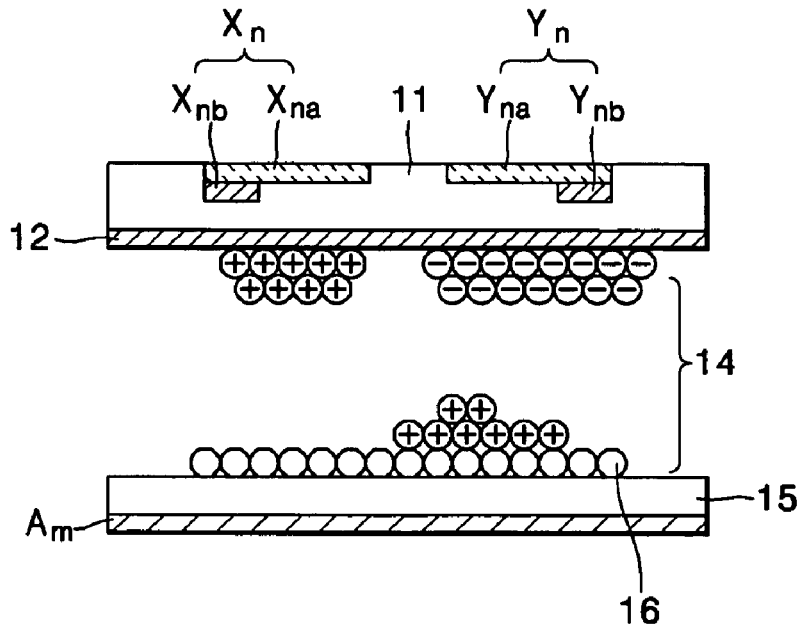
FIG. 5 is a schematic sectional view showing the distribution of wall charges in a display cell at time t3 of FIG. 4.
Figure 6:
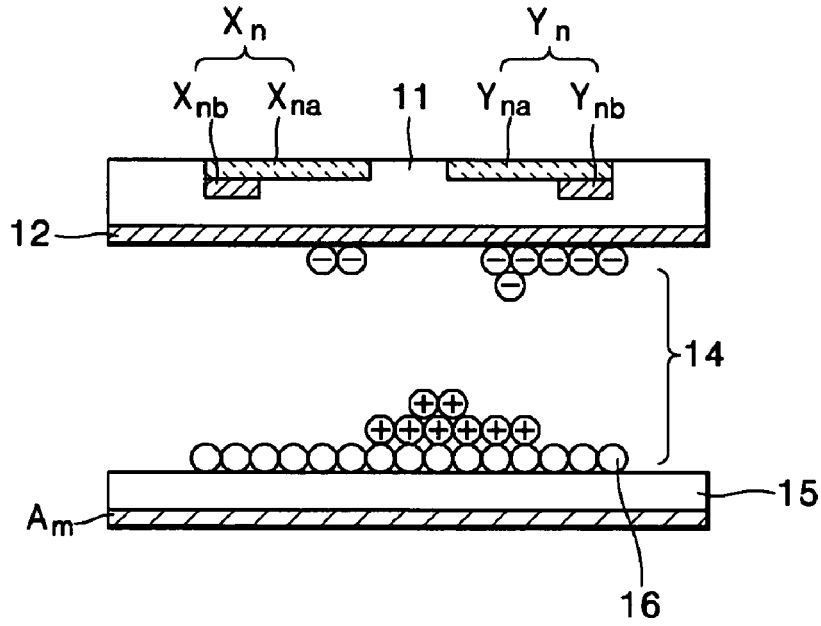
FIG. 6 is a schematic sectional view showing the distribution of wall charges in a display cell at time t4 of FIG. 4.

FIG. 4 is a waveform diagram illustrating the waveforms of driving signals applied to the electrode lines of the plasma display panel 1 of FIG. 1 in a unit sub-field, using a driving method according to embodiments of the invention. In FIG. 4, components having the same reference numbers as those of FIG. 2 operate in the same manner as the respective components of FIG. 2. FIG. 5 is a schematic sectional view illustrating the distribution of wall charges in the display cell at a time t3 just after a gradually increasing voltage is applied to Y electrode lines $Y_1, \ldots, Y_n$ as second display electrode lines in a resetting period R of FIG. 4. FIG. 6 is a schematic sectional view illustrating the distribution of wall charges in a display cell at a termination time t4 of the resetting period R of FIG. 4. In FIGS. 5 and 6, components having the same reference numbers as those of FIG. 2 operate in the same manner as the respective components of FIG. 2.

As shown in FIG. 4, in a first time period between times t1 and t2 of a resetting period R in a unit sub-field SF, a voltage applied to X electrode lines $X_1, \ldots, X_n$ gradually increases from a ground voltage $V_G$ to a second voltage $V_S$, for example, to about 155 V. The ground voltage $V_G$ is applied between the X electrode lines and the Y electrode lines. Consequently, a weak discharge is generated between the X electrode lines $X_1, \ldots, X_n$ and the Y electrode lines $Y_1, \ldots, Y_n$, thereby forming wall charges with negative polarities around the X electrode lines $X_1, \ldots, X_n$.

In a second time period between times t2 and t3 when wall charges are accumulated, the voltage applied to the Y electrode lines $Y_1, \ldots, Y_n$ gradually increases from the second voltage $V_S$ (for example, about 155 V) to a first voltage $V_{SET}+V_S$ (for example, about 355 V) higher by a fourth voltage $V_{SET}$ than the second voltage $V_S$. Here, the ground voltage $V_G$ is applied between the X electrode lines $X_1, \ldots, X_n$ and the address electrode lines $A_{R1}, \ldots, A_{Bm}$. Consequently, a weak discharge is generated between the Y electrode lines $Y_1, \ldots, Y_n$ and the X electrode lines $X_1, \ldots, X_n$, while a weaker discharge is generated between the Y electrode lines $Y_1, \ldots, Y_n$ and the address electrode lines $A_{R1}, \ldots, A_{Bm}$. Generally, the discharge between the Y electrode lines $Y_1, \ldots, Y_n$ and the X electrode lines $X_1, \ldots, X_n$ is stronger than the discharge between the Y electrode lines $Y_1, \ldots, Y_n$ and the address electrode lines $A_{R1}, \ldots, A_{Bm}$ because of the wall charges with negative polarities that are formed around the X electrode lines $X_1, \ldots, X_n$. More particularly, many wall charges with negative polarities are formed around the Y electrode lines $Y_1, \ldots, Y_n$, wall charges with positive polarities are formed around the X electrode lines $X_1, \ldots, X_n$, and a small number of wall charges with positive polarities are formed around the address electrode lines $A_{R1}, \ldots, A_{Bm}$ (see FIG. 5).

In a third time period between times t3 and t4, when the wall charges are distributed, while the second voltage $V_S$ is applied to the X electrode lines $X_1, \ldots, X_n$, a voltage is applied to the Y electrode lines $Y_1, \ldots, Y_n$ gradually decreases from the second voltage $V_S$ to the ground voltage $V_G$ as a third voltage. Here, the ground voltage $V_G$ is applied to the address electrode lines $A_{R1}, \ldots, A_{Bm}$. Consequently, by the weak discharge between the X electrode lines $X_1, \ldots, X_n$ and the Y electrode lines $Y_1, \ldots, Y_n$, a portion of the wall charges with negative polarities around the Y electrode lines $Y_1, \ldots, Y_n$ moves near to the X electrode lines $X_1, \ldots, X_n$ (see FIG. 6). Thus, the wall electric-potential of the X electrode lines $X_1, \ldots, X_n$ becomes lower than the wall electric-potential of the address electrode lines $A_{R1}, \ldots, A_{Bm}$ and becomes higher than the wall electric-potential of the Y electrode lines $Y_1, \ldots, Y_n$. Therefore, it is possible to reduce the addressing voltage $V_A - V_G$ required for opposite discharge between the Y electrode lines and address electrode lines selected in the following addressing time A.

In the third time period of the method described above, when the wall charges are distributed, because all the address electrode lines $A_{R1}, \ldots, A_{Bm}$ are electrically floated during a predetermined time $T_{AF}$, certain beneficial effects are obtained (see FIG. 6). One beneficial effect is that in the third time period between times t3 and t4, the address electrode lines $A_{R1}, \ldots, A_{Bm}$ do not perform discharge for the X electrode lines $X_1, \ldots, X_n$ and the Y electrode lines $Y_1, \ldots, Y_n$. Therefore, the contrast performance of a plasma display device can be enhanced.

Additionally, since the address electrode lines $A_{R1}, \ldots, A_{Bm}$ do not perform discharge in the floating time t3 through t4, in the second time period between times t2 and t3 when the wall charges are accumulated, wall charges with positive polarities formed around the address electrode lines $A_{R1}, \ldots, A_{Bm}$ do not disappear and are largely maintained in the floating time t3 through t4. Accordingly, since the positive polarity wall electric-potential on the address electrode lines $A_{R1}, \ldots, A_{Bm}$ does not decrease, the addressing voltage required to generate discharge between the Y electrode lines and address electrode lines selected in the addressing time A following the resetting period R does not increase.

In the following addressing time A, a display data signal is applied to the address electrode lines $A_{R1}, \ldots, A_{Bm}$ and an injection signal with the ground voltage $V_G$ is applied sequentially to the Y electrode lines $Y_1, \ldots, Y_n$ biased by a fifth voltage $V_{SCAN}$ lower than the second voltage $V_S$, so that addressing can be performed smoothly. As the display data signal is applied to each of the address electrode lines $A_{R1}, \ldots, A_{Bm}$, an addressing voltage $V_A$ with a positive polarity is applied to selected display cells, and the ground voltage $V_G$ is applied to the remaining non-selected display cells. Therefore, if the display data signal with the positive-polarity addressing voltage $V_A$ is applied while the injection pulses with the ground voltage $V_G$ are applied, an addressing discharge occurs, forming wall charges in the corresponding display cells, whereas no wall charges are formed in the remaining display cells. In order to, to correctly and efficiently perform addressing discharge, the second voltage $V_s$ is constantly applied to the X electrode lines $X_1, \ldots, X_n$.

In the following display-sustain time S, display-sustain pulses with the second voltage $V_S$ are alternately applied to all the Y electrode lines $Y_1, \ldots, Y_n$ and all the X electrode lines $X_1, \ldots, X_n$, so that display-sustain discharge is generated in the display cells with wall charges formed in the corresponding addressing time A.

Using the above-described method, if the display-sustain time of a sub-field is set to be relatively short, an insufficient number of wall charges may be formed in the resetting period R of the following sub-field SF. Consequently, an insufficient number of wall charges may be formed in the display cells selected in the addressing time A, which may weaken the discharge during the display-sustain time S. Stated otherwise, the uniformity and stability of the display may be adversely affected if the display-sustain time is too short. This basic problem can also be ameliorated or resolved using the resetting method according to the present invention, as will be described below.

Figure 7:
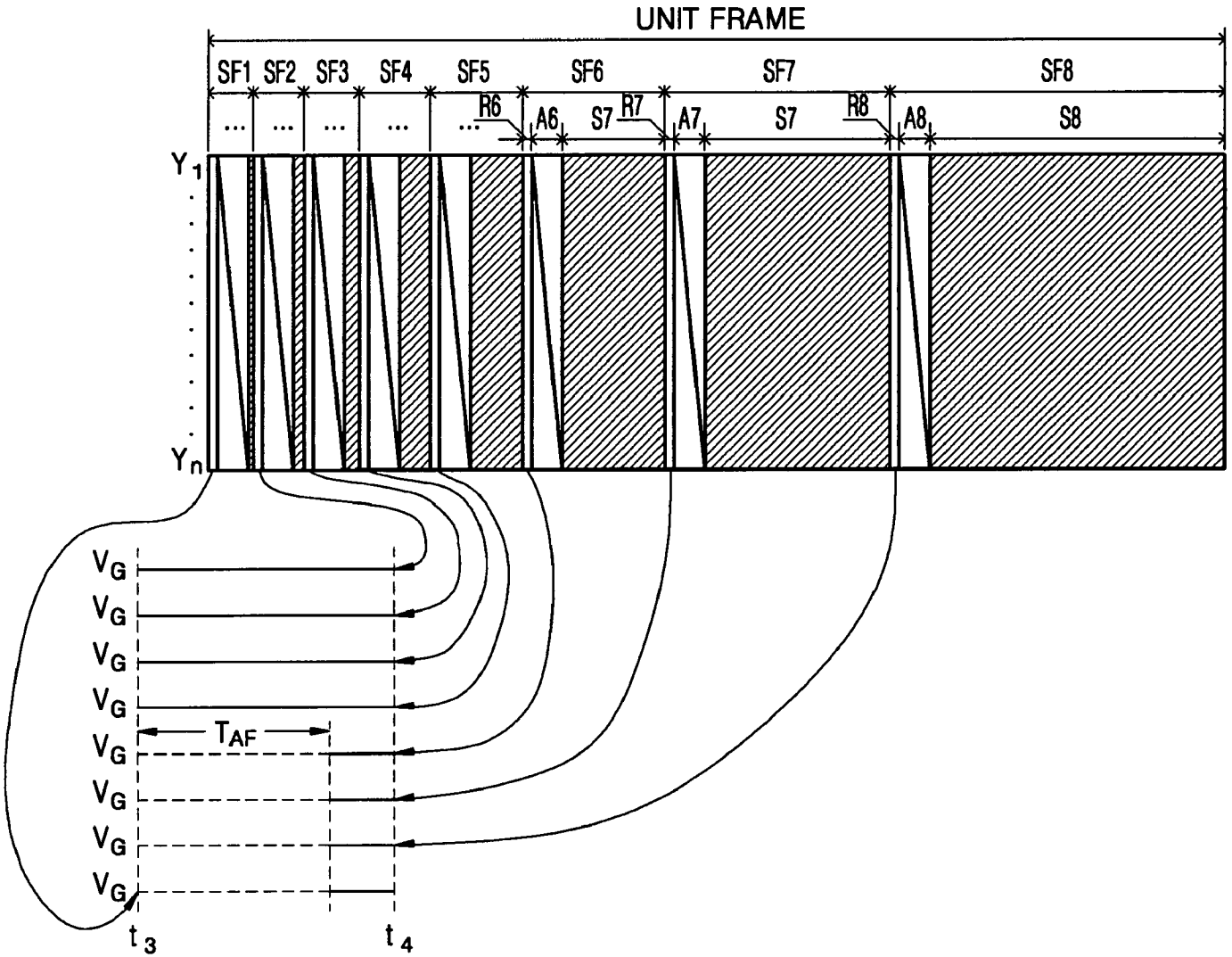
FIG. 7 is a diagram of the sub-fields in a typical unit frame, illustrating an example of implementing methods according to embodiments of the invention using a display-sustain time in a previous sub-field.

FIG. 7 illustrates an example of implementing the resetting method of FIG. 4 and considering the display-sustain times S1 through S8 in a previous sub-field. In general, the scheme shown in FIG. 7 is that of time-division gradation display. Each unit frame is partitioned into 8 sub-fields SF1, . . . , SF8 in order to implement time-division gradation display. Additionally, the sub-fields SF1, . . . , SF8 are divided into respective resetting periods R1, . . . , R8, addressing periods A1, . . . , A8, and display-sustain periods S1, . . . , S8.

During the resetting periods, the discharge conditions of all the display cells are made uniform so as to facilitate the subsequent addressing operation. In each of the subsequent addressing periods A1, . . . , A8, the display data signal is applied sequentially to the address electrode lines ($A_{R1}, \ldots, A_{Bm}$ of FIG. 1) while injection pulses corresponding to each of the Y electrode lines $Y_1, \ldots, Y_n$ are applied sequentially to the address electrode lines. Accordingly, if a display data signal with a high level is applied while the injection pulses are applied, wall charges are generated by address discharge in corresponding discharge cells and no wall charge is generated in the remaining discharge cells.

In each of the display sustain times S1, . . . , S8, display sustain pulses are applied alternately to all the Y electrode lines $Y_1, \ldots, Y_n$ and all the X electrode lines $X_1, \ldots, X_n$, so that the discharge cells in which the wall charges are formed undergo display discharge in the corresponding addressing times A1, . . . , A8. Accordingly, luminance of the plasma display panel is proportional to a length of a display sustain time S1, . . . , S8 occupied by a unit frame. The length of the display sustain time S1, . . . , S8 occupied by a unit frame is 255T (T is an unit of time). Accordingly, the length of the display sustain time S1, . . . , S8 can be represented by 256 gradations including a case in which a zero (0) gradation is not displayed in the unit frame.

Here, a display sustain time S1 of a first sub-field SF1 is set to a time 1T corresponding to $2^0$, a display sustain time S2 of a second sub-field SF2 is set to a time 2T corresponding to $2^1$, a display sustain time S3 of a third sub-field SF3 is set to a time 4T corresponding to $2^2$, a display sustain time S4 of a fourth sub-field SF4 is set to a time 8T corresponding to $2^3$, a display sustain time S5 of a fifth sub-field SF5 is set to a time 16T corresponding to $2^4$, a display sustain time S6 of a sixth sub-field SF6 is set to a time 32T corresponding to $2^5$, a display sustain time S7 of a seventh sub-field SF7 is set to a time 64T corresponding to $2^6$, and a display sustain time S8 of an eighth sub-field SF8 is set to a time 128T corresponding to $2^7$, respectively.

Accordingly, by appropriately selecting sub-fields to be displayed among the eight sub-fields, a display with 256 gradations including a zero (0) gradation that is not displayed on any sub-field can be implemented.

In the context of the present invention, and as shown in FIG. 7, electrical floating of the address electrode lines $A_{R1}, \ldots, A_{Bm}$ in a present sub-field is performed or not performed depending on the display-sustain times S1 through S8 in the previous sub-field.

In the resetting periods (R6 through R8, R1) of the sub-fields (SF6 through SF8, SF1) following the previous sub-fields with relatively long display-sustain times S5 through S8, the address electrode lines $A_{R1}, \ldots, A_{Bm}$ are electrically floated for a portion $T_{AF}$ of the wall charge distribution time t3 through t4 of FIG. 4. Additionally, in the resetting period R2 through R5 of the sub-fields SF2 through SF5 following the previous sub-fields with relatively short display-sustain times S1 through S4, the ground voltage $V_G$ is constantly applied to the address electrode lines $A_{R1}, \ldots, A_{Bm}$. Accordingly, the display-sustain times S1 through S8 of the previous sub-fields have a uniform influence on the operations of the present sub-field.

Figure 8:
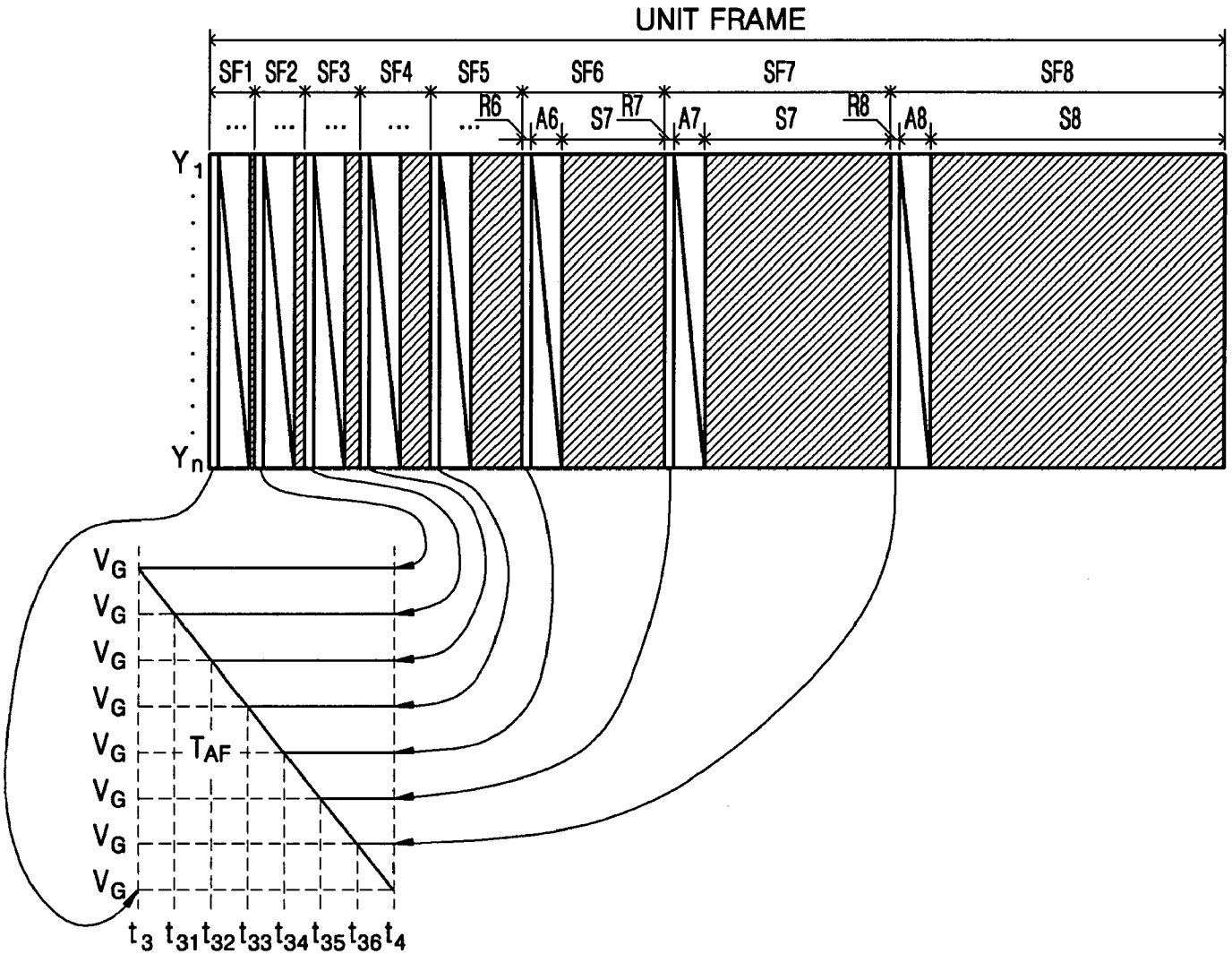
FIG. 8 is a diagram similar to that of FIG. 7 illustrating an embodiment in which a floating time is set to be proportional to the display-sustain times of the previous sub-fields.

FIG. 8 is a diagram similar to that of FIG. 7, illustrating an example in which the floating time $T_{AF}$ is set to be proportional to the display-sustain times S1 through S8 of the previous sub-fields in the resetting method of FIG. 4.

As shown in FIG. 8, in the respective resetting periods R1 through R8 of the sub-fields SF1 through SF8, the floating time $T_{AF}$ included in the wall charge distribution time t3 through t4 is proportional to the display-sustain times (S8, S1 through S7) of the previous sub-fields (SF8, SF1 through SF7). For example, in the resetting period R1 of the first sub-field SF1 following the previous sub-field SF8 with the longest display-sustain time S8, the floating time $T_{AF}$ of the address electrode lines $A_{R1}, \ldots, A_{Bm}$ occupies the entire portion of the wall charge distribution time t3 through t4. Also, in the resetting period R2 of the second sub-field SF2 following the previous sub-field SF1 with the shortest display-sustain time S1, there is no floating time $T_{AF}$ for the address electrode lines $A_{R1}, \ldots, A_{Bm}$ during the wall charge distribution time t3 through t4. Accordingly, the display-sustain times S1 through S8 of the previous sub-fields have a uniform influence on the operations of the present sub-field.

As was described above, in methods according to embodiments of the present invention, since address electrode lines $A_{R1}, \ldots, A_{Bm}$ are electrically floated when the wall charges are distributed, several beneficial effects are obtained. First, the address electrode lines do not perform discharge for X and Y electrode lines when the wall charges are distributed. Therefore, the contrast performance of a plasma display device can be enhanced. Second, since the address electrode lines do not perform discharge in the wall charge distribution time, wall charges with positive polarities formed around the address electrode lines do not disappear and are largely maintained in the wall charge accumulation time. Therefore, since the positive polarity wall electrical-potential of the address electrode lines does not decrease, the addressing voltage required for discharge between the Y electrode lines and the address electrode lines selected in an addressing time following the resetting period does not increase.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of resetting a plasma display panel having a three-electrode discharge cell configuration, comprising:

gradually increasing a voltage applied to second display electrode lines to reach a first voltage;

gradually decreasing a voltage applied to the second display electrode lines to reach a third voltage lower than a second voltage; and electrically floating address electrode lines while maintaining a voltage applied to first display electrode lines at the second voltage lower than the first voltage, wherein the third voltage is applied to the address electrode lines during the time period in which the voltage applied to the second display electrode lines is gradually increased, and wherein the address electrode lines are electrically floated for at least a portion of the time period in which the voltage applied to the second display electrode lines is gradually decreased, the address electrode lines being electrically floated only while the voltage applied to the second display electrode lines is gradually decreased.

2. The method of claim 1, further comprising:

gradually increasing a voltage applied to the first display electrode lines to reach the second voltage before gradually increasing the voltage applied to the second display electrode lines to reach the first voltage.

3. The method of claim 1, wherein the second voltage is about 155V.

4. The method of claim 1, wherein the first voltage is about 355V.

5. A method for driving a plasma display panel having a three-electrode discharge cell configuration, comprising:

dividing a unit frame into a plurality of sub-fields for time-division gradation display and performing resetting, addressing, and display sustain in the plurality of sub-fields, said resetting comprising, in at least one sub-field of the plurality of sub-fields:

gradually increasing a voltage applied to second display electrode lines to reach a first voltage;

gradually decreasing a voltage applied to the second display electrode lines to reach a third voltage lower than a second voltage; and electrically floating address electrode lines while maintaining a voltage applied to first display electrode lines at the second voltage lower than the first voltage, wherein the third voltage is applied to the address electrode lines during the time period in which the voltage applied to the second display electrode lines is gradually increased, and wherein the address electrode lines are electrically floated for at least a portion of the time period in which the voltage applied to the second display electrode lines is gradually decreased, the address electrode lines being electrically floated only while the voltage applied to the second display electrode lines is gradually decreased.

6. The method of claim 5, further comprising:

gradually increasing a voltage applied to the first display electrode lines to reach the second voltage before gradually increasing the voltage applied to the second display electrode lines to reach the first voltage.

7. The method of claim 5, wherein in gradually decreasing the voltage applied to the second display electrode lines and electrically floating the address electrode lines, the duration of the time period during which the address electrode lines are floated is proportional to a time period required for a display-sustain operation in a previous sub-field.

8. The method of claim 5, wherein the second voltage is about 155V.

9. The method of claim 5, wherein the first voltage is about 355V.

10. A method of driving a plasma display panel having a three-electrode discharge cell configuration, comprising:

during a resetting operation on one or more of the discharge cells, electrically floating an address electrode, wherein the resetting operation comprises:

gradually increasing a voltage applied to second display electrode lines to reach a first voltage;

gradually decreasing a voltage applied to the second display electrode lines to reach a third voltage lower than a second voltage; and performing said floating while maintaining a voltage applied to first display electrode lines at the second voltage lower than the first voltage, wherein the third voltage is applied to the address electrode during the time period in which the voltage applied to the second display electrode lines is gradually increased, and wherein the address electrode is electrically floated for at least a portion of the time period in which the voltage applied to the second display electrode lines is gradually decreased, the address electrode lines being electrically floated only while the voltage applied to the second display electrode lines is gradually decreased.

11. The method of claim 10, further comprising:

gradually increasing a voltage applied to the first display electrode lines to reach the second voltage before gradually increasing the voltage applied to the second display electrode lines to reach the first voltage.

12. The method of claim 10, wherein the method further comprises dividing a unit frame into a plurality of sub-fields for time-division gradation display and performing said resetting operation, an addressing operation, and a display sustain operation in one or more sub-fields of the plurality of sub-fields.

13. The method of claim 10, wherein the second voltage is about 155V.

14. The method of claim 10, wherein the first voltage is about 355V.

15. The method of claim 10, wherein the method is performed in order.

* * * * *